US005816906A

United States Patent [19]

Mai

[11] Patent Number: 5,816,906

[45] Date of Patent: Oct. 6, 1998

[54] VENTED HOOD WITH FILTER

[76] Inventor: Hoang T. Mai, 1129 Tamari Dr., Baton Rouge, La. 70815

[21] Appl. No.: 904,641

[22] Filed: Aug. 1, 1997

[51] Int. Cl.[6] ..... B08B 25/02

[52] U.S. Cl. ..... 454/56; 45/67; 55/467

[58] Field of Search ..... 454/56, 67; 55/467, 55/473

[56] References Cited

U.S. PATENT DOCUMENTS

| | | | |
|---|---|---|---|
| 4,038,913 | 8/1977 | Earley | 98/115 |
| 4,179,984 | 12/1979 | Gorcey | 98/115 |
| 4,252,054 | 2/1981 | Bakels | 98/115 |
| 4,553,992 | 11/1985 | Boissinot | 55/279 |
| 4,647,295 | 3/1987 | Christ | 55/97 |
| 4,852,468 | 8/1989 | Harris | 98/115.3 |
| 4,967,775 | 11/1990 | Kaiser | 132/73 |
| 5,112,373 | 5/1992 | Pham | 55/316 |
| 5,262,578 | 11/1993 | Hall | 588/249 |
| 5,464,029 | 11/1995 | Renz | 132/73.5 |

*Primary Examiner*—Carroll D. Dority
*Attorney, Agent, or Firm*—David L. Ray

[57] ABSTRACT

A hood for placement on a table or work station which covers the hands of the worker and customer who is having a manicure or who is having artificial fingernails attached or replaced. The hood includes two spaced apart side walls positionable on the horizontal surface of the work station, a cover extending between the two spaced apart side walls, the cover having a top side and a bottom side, the top side of the cover having an opening therein through which fumes underneath the cover may be vented, the bottom side of the cover being located at a distance above the work station sufficient for the hands of a worker to be placed therebeneath, and a filter box pivotally connected to the top side of the cover directly above the opening in the cover by a hinge, the filter box having a filter therein for filtering chemicals and fumes from the air beneath the cover, the filter box having an electric motor having a fan blade connected thereto for pulling air from beneath the cover through the filter and exhausting the filtered air from the filter box.

14 Claims, 2 Drawing Sheets

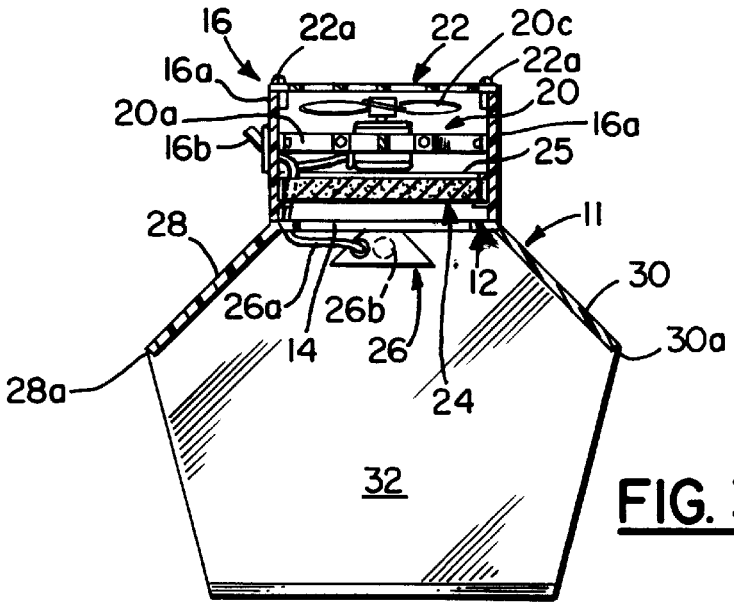
FIG. 3.
FIG. 5.
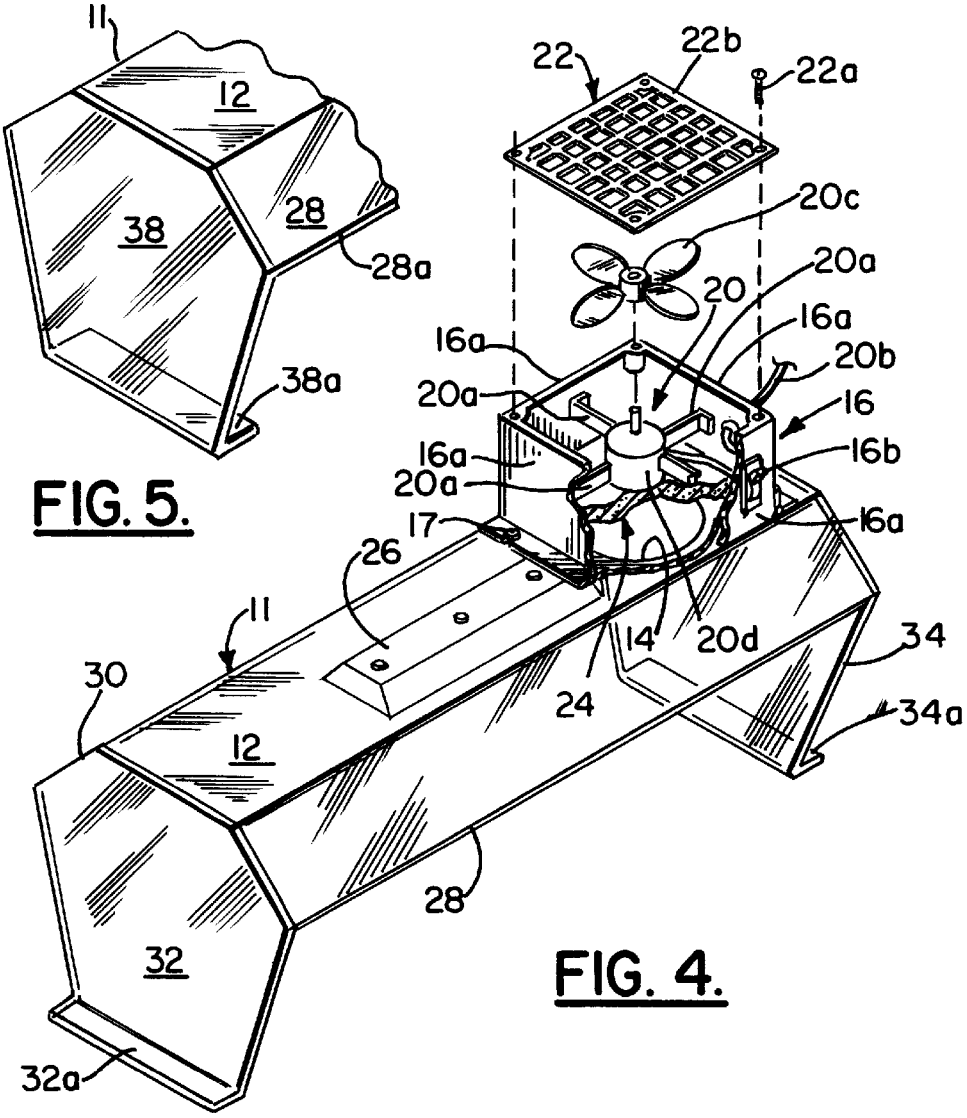
FIG. 4.

VENTED HOOD WITH FILTER

BACKGROUND OF THE INVENTION

1. Field of the Invention

The invention relates to devices for removing fumes from a work station. In particular, the invention relates to a device for removing irritating fumes and vapor emanating from chemicals and vapors encountered when manicuring or replacing artificial finger nails.

2. Description of the Related Art

It is known in the art that fumes from chemicals used in manicuring finger nails and in replacement and removal of artificial finger nails have an annoying odor. Furthermore, it is known that such fumes can cause irritation of the lungs and lining of the nose. Sometimes the fumes can be so intense that workers who have been exposed to the fumes over a long period of time may suffer headaches and dizziness from inhaling and breathing the fumes. Workers also complain of eye irritation, chronic nasal or sinus problems including running nose, and sneezing. Also, workers sometimes have ringing in the ears, facial skin reactions ranging from rashes to acne, and finger and hand dermatitis.

Exemplary of the Patents of the related art are the following U.S. Pat. Nos.: 5,464,029; 5,262,578; 5,112,373; 4,967,775; 4,852,468; 4,647,295; 4,553,992; 4,252,054; 4,179,984; and 4,038,913.

SUMMARY OF THE INVENTION

In accordance with the present invention there is provided a hood for placement on a table or work station which covers the hands of the worker and customer who is having a manicure or who is having artificial fingernails attached or replaced. The hood includes two spaced apart side walls positionable on the horizontal surface of the work station, a cover extending between the two spaced apart side walls, the cover having a top side and a bottom side, the top side of the cover having an opening therein through which fumes underneath the cover may be vented, the bottom side of the cover being located at a distance above the work station sufficient for the hands of a worker to be placed therebeneath, and a filter box pivotally connected to the top side of the cover directly above the opening in the cover by a hinge, the filter box having a filter therein for filtering chemicals and fumes from the air beneath the cover, the filter box having an electric motor having a fan blade connected thereto for pulling air from beneath the cover through the filter and exhausting the filtered air from the filter box.

BRIEF DESCRIPTION OF THE DRAWINGS

FIG. 3 is a cross-sectional view taken along lines 3—3 of FIG. 2;

FIG. 4 is a perspective exploded partly cut away view of the apparatus of the invention; and FIG. 5 is a partly cut-away perspective view of an alternate embodiment of the apparatus of the invention.

DESCRIPTION OF THE PREFERRED EMBODIMENTS

Figure 1:
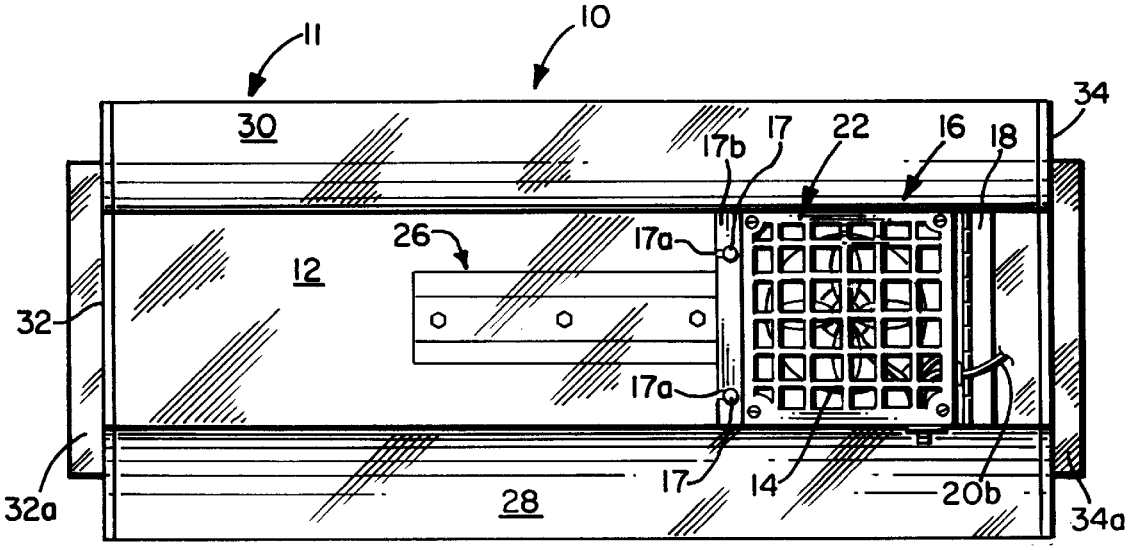
FIG. 1 is a top plan view of the apparatus of the invention.

Referring now to the drawings, the hood of the invention is generally indicated by the numeral 10. Hood 10 can be seen to include a cover generally indicated by the numeral

11. Cover 11 includes rectangular panels 28 and 30 and a top rectangular roof generally indicated by the numeral 12 which is preferably made of a transparent plastic material such as PLEXIGLAS or the like. Roof 12 has a vent or opening 14 therein through which air and chemical fumes can flow from underneath cover 11 to the filter box generally indicated by the numeral 16. Preferably, opening 14 is circular and has a diameter of about six inches.

Preferably, roof 12 and rectangular panels 28 and 30 are equal in size and are about three feet in length and about eight inches in width. Preferably, rectangular panels 28 and 30 slope downwardly from roof 12 at an angle of about 45 degrees.

Filter box 16 is pivotally connected to roof 12 by hinge 18. Hinge 18 may be connected to roof 12 and filter box 16 by any suitable method or materials known in the art, such as an adhesive or by screws. The opposite side of box 16 from the side having hinge 18 is held in place preferably by two easily removable thumb screws 17—17 until it is desired to pivot the box 16 upwardly as shown by phantom lines in FIG. 16. Thumb screws 17 fit into slots 17*a*—17*a* in lip 17*b* of box 16.

Filter box 16 includes a fan assembly generally indicated by the numeral 20. Filter box 16 preferably has four rectangular side walls 16*a* which are joined at their edges as shown in the drawings. Preferably, rectangular side walls 16*a* are made of plywood and covered with FORMICA. One of the side walls 16*a* has a switch 16*b* for activating fan assembly 20. Fan assembly 20 is rigidly connected to the inside of rectangular side walls 16*a* by braces 20*a*. Fan assembly 20 has a power cord 20*b* which extends to a source of electrical energy such as a wall plug receptacle. Fan assembly 20 has fan blade 20*c* which is rotated by an electrical motor 20*d*.

A rectangular grill generally indicated by the numeral 22 is attached to the top of filter box 16 by screws 22*a*. Grill 22 has openings 22*b* therein which enable air to flow therethrough when air is driven by fan 20.

Located beneath fan motor 20*d* is a rectangular filter generally indicated by the numeral 24. Filter 24 is generally rectangular in shape and fits snugly inside of the side wall 16*a* of filter box 16. Preferably, filter 24 fits snugly into filter box 16. Cross bar 25 extends from the inside of opposite sidewalls 16*a* to limit the upward movement of filter 24. Preferably, filter 24 is square in shape and has sides which are about eight inches in length and one inch thick. Filter 24 is preferably activated charcoal. Preferably, filter 24 has two layers of activated charcoal with a layer of perlite therebetween, the two layers of activated charcoal being fastened together or sealed with cotton thread. However, if desired, other filtration media may be utilized in filter 24 which will remove chemical fumes encountered in manicuring and finger nail replacement operations.

Figure 2:
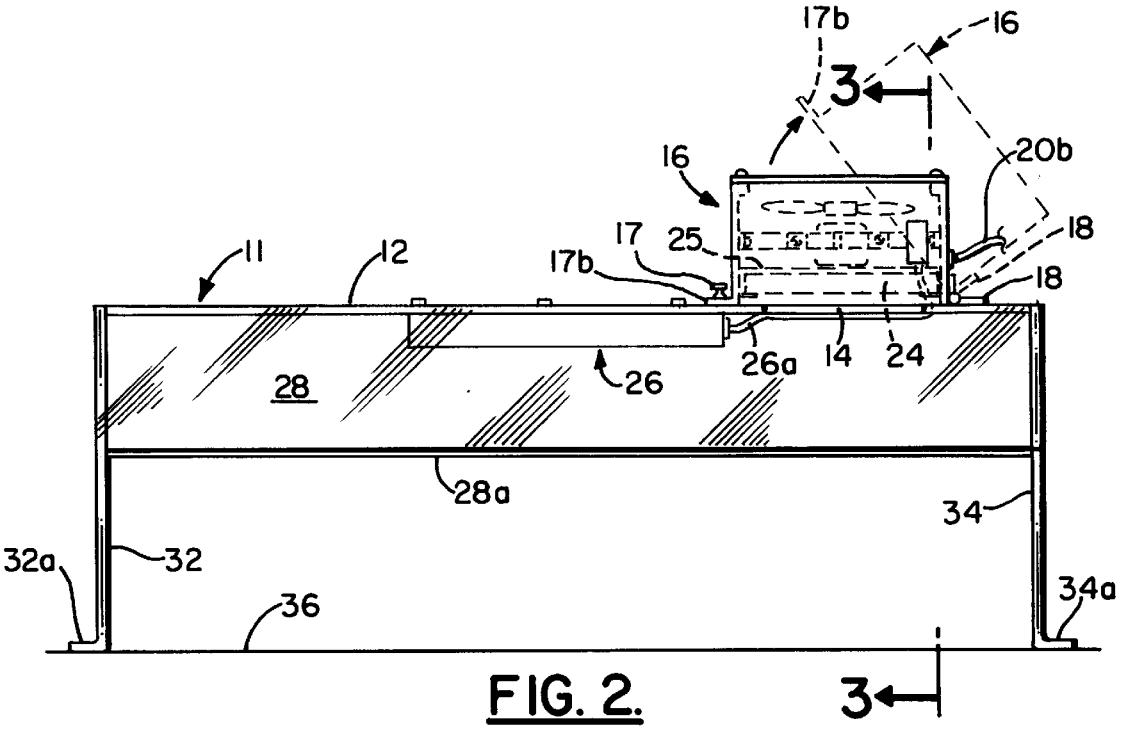
FIG. 2 is a side, elevational view of the apparatus of the invention.

Filter 24 may easily be replaced by removing thumb screws 17 and pivoting filter box 16 upwardly as shown in FIG. 2. The hinged filter box 16 thereby provides for easy replacement of filter 24. Such easy replacement is important since the filter might have to be changed frequently when the filtration media is filled with the fumes removed from the air.

Connected to the bottom of roof 12 is a conventional lighting fixture generally indicated by the numeral 26. Lighting fixture 26 has an electrical cord 26*a* extending therefrom and leading to an electrical plug outlet for energizing the lighting contained in light box 26. As can be seen in FIG. 3 light box 26 preferably contains an elongated fluorescent light bulb 26*b*.

Rigidly connected to rectangular roof 12 are two downwardly sloping rectangular panels 28 and 30. Panels 28 and 30 are sealed at their upper edges to roof 12 to trap fumes emanating from chemicals placed beneath cover 11.

Connected to the ends of roof 12 and rectangular panels 28 and 30 are two side walls 32 and 34. Side walls 32 and 34 support roof 12 and rectangular panels 28 and 30 at a distance above the upper surface 36 indicated in FIG. 2 of a work station or table on which the hood 10 may be placed. Side walls 32 and 34 are also preferably constructed of the same materials as roof 12 and panels 28 and 30, the preferred material being transparent plastic materials such as PLEXIGLAS. The sidewalls 32 and 34, and rectangular panels 28 and 30, and roof 12 may be joined together by any suitable method or material known in the art, such as an adhesive. If desired, the sidewalls 32 and 34, rectangular panels 28 and 30, and roof 12 may be integrally formed together.

The bottom edges 28*a* and 30*a* of rectangular panels 28 and 30, respectively, are located at a distance above the surface 36 of the work station sufficient for the hands of a worker and a customer to be placed therebeneath. Preferably, the bottom edge 28*a* and 30*a* of rectangular panels 28 and 30, respectively, are located at a distance above the surface 36 of the work station of about eight inches to enable the worker to have both forearms, and the hands and fingers maneuvering easily under the rectangular panels 28 and 30 and roof 12. All work, such as mixing different chemicals, epoxy glues, polish, preparation of the customer's fingernails, and removal and application of artificial fingernails, is done under cover 11. Any fumes and dust will rise and be drawn to and through the filter 24 by the fan 20*c*.

At the bottom of side walls 32 and 34 there is preferably a lip 32*a* and 34*a* respectively as shown in FIG. 4. Preferably lips 32*a* an 34*a* extends outwardly from the work area located between side walls 32 and 34.

An alternate embodiment of the invention is shown in FIG. 5. In FIG. 5 the side walls 32 and 34 are each replaced with side walls 38 having a lip 38*a* that is turned inwardly toward the work area.

If desired, the lips 32*a*, 34*a* and 38*a* could be eliminated and the hood could rest on the bottom edge of side walls 32, 34 or 38.

Furthermore, if desired, the apparatus of the invention could be used for work stations other than manicuring or artificial fingernail work which expose the worker to irritating chemical fumes.

Although the preferred embodiments of the invention have been described in detail above, it should be understood that the invention is in no sense limited thereby, and its scope is to be determined by that of the following claims:

What is claimed is:

1. An apparatus for removing fumes from a work station having a horizontal surface, said apparatus comprising:

a. two spaced apart side walls positionable on said horizontal surface of said work station, b. a cover extending between said two spaced apart side walls, said cover having a top side and a bottom side, said top side of said cover having an opening therein through which fumes underneath said cover may be vented, said bottom side of said cover being located at a distance above said work station sufficient for the hands of a worker to be placed therebeneath, and c. a filter box pivotally connected to said top side of said cover above said opening in said cover by a hinge, said filter box having a filter therein for filtering chemicals and fumes from the air beneath said cover, said filter box having an electric motor having a fan blade connected thereto for pulling air from beneath said cover through said filter and exhausting said filtered air from said filter box.

2. The apparatus of claim 1 wherein said cover is made from a transparent material.

3. The apparatus of claim 2 wherein said cover is made from a transparent plastic material.

4. The apparatus of claim 2 wherein said cover is made from PLEXIGLAS.

5. The apparatus of claim 1 wherein said filter box has at least one removable fastener connected thereto which can be easily removed to enable said filter box to be pivoted about said hinge to remove and replace said filter.

6. The apparatus of claim 1 wherein said cover has a light connected to said bottom side of said cover.

7. The apparatus of claim 1 wherein said cover includes a horizontal rectangular roof having said opening therein.

8. The apparatus of claim 7 wherein said cover includes two downwardly sloping rectangular panels.

9. The apparatus of claim 8 wherein said roof is connected to said two downwardly sloping rectangular panels.

10. The apparatus of claim 9 wherein said two sidewalls are connected to said roof and to said two downwardly sloping rectangular panels.

11. The apparatus of claim 10 wherein said two sidewalls have a lip on the bottom edge thereof.

12. The apparatus of claim 1 wherein said fan blade is located above said filter.

13. The apparatus of claim 1 wherein said sidewalls are parallel.

14. The apparatus of claim 2 wherein said cover is connected perpendicularly to said side walls.

* * * * *